US008576159B2

(12) United States Patent
Cho et al.

(10) Patent No.: US 8,576,159 B2
(45) Date of Patent: Nov. 5, 2013

(54) DRIVING METHOD FOR LOCAL DIMMING OF LIQUID CRYSTAL DISPLAY DEVICE AND APPARATUS USING THE SAME

(75) Inventors: Dae-Ho Cho, Seoul (KR); Kyung-Joon Kwon, Seoul (KR); Hee-Won Ahn, Goyang-si (KR); Chang-Kyun Park, Incheon (KR)

(73) Assignee: LG Display Co., Ltd., Seoul (KR)

( * ) Notice: Subject to any disclaimer, the term of this patent is extended or adjusted under 35 U.S.C. 154(b) by 670 days.

(21) Appl. No.: 12/827,498

(22) Filed: Jun. 30, 2010

(65) Prior Publication Data

US 2011/0141077 A1 Jun. 16, 2011

(30) Foreign Application Priority Data

Dec. 11, 2009 (KR) ..... 10-2009-0123597

(51) Int. Cl.
*G09G 3/36* (2006.01)
*G09G 5/10* (2006.01)

(52) U.S. Cl.
USPC ..... 345/102; 345/690

(58) Field of Classification Search
None
See application file for complete search history.

(56) References Cited

U.S. PATENT DOCUMENTS 7,050,074 B1 5/2006 Koyama
7,227,519 B1 6/2007 Kawase et al.
2008/0068293 A1 3/2008 Ishii
2008/0309611 A1 12/2008 Yang
2010/0066752 A1* 3/2010 Watanuki ..... 345/589
2010/0110111 A1* 5/2010 Kim et al. ..... 345/690
2010/0156777 A1* 6/2010 Kang et al. ..... 345/102
2010/0156955 A1* 6/2010 Kimura ..... 345/690
2010/0225673 A1* 9/2010 Miller et al. ..... 345/690
2011/0063201 A1* 3/2011 Karrenbauer et al. ..... 345/102

* cited by examiner

*Primary Examiner* — Joseph Haley
*Assistant Examiner* — Emily Frank
(74) *Attorney, Agent, or Firm* — McKenna Long & Aldridge, LLP

(57) ABSTRACT

A driving method for local dimming of a Liquid Crystal Display (LCD) device and an apparatus using the same are disclosed. The driving method includes measuring light intensities at a plurality of sampling points by driving a light source of a backlight unit and storing the light intensity measurements as light intensity data of the sampling points in a memory, determining a local dimming value of each block by analyzing input image data on a block basis, detecting a pixel position of current input data, selecting a plurality of sampling points adjacent to the current pixel and the light intensity data of the sampling points from the memory, detecting light intensity data of the current pixel by linearly interpolating the light intensity data of the sampling points individually, calculating a gain value by a light intensity analysis based on the light intensity data of the current pixel and the local dimming value of each block, compensating the current input data using the gain value, and controlling luminance of the backlight unit on a block basis using the local dimming value of each block.

11 Claims, 6 Drawing Sheets

(a) LIGHT SHAPE IN CASE OF DRIVING SINGLE BLOCK (b) SAMPLING POINTS OF WHICH LIGHT INTENSITIES ARE STORED

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 1 | 0 | 0 | 0 | 0 | 0 | 0 | 0 | 0 | 0 | 0 | 0 | 0 | 0 | 0 | 0 |
| 2 | 0 | 0 | 0 | 0 | 0 | 1 | 1 | 2 | 2 | 2 | 2 | 3 | 3 | 4 | 4 |
| 3 | 0 | 0 | 0 | 0 | 0 | 1 | 2 | 3 | 3 | 4 | 4 | 5 | 5 | 5 | 5 |
| 4 | 0 | 0 | 0 | 0 | 0 | 1 | 2 | 3 | 3 | 4 | 5 | 6 | 6 | 6 | 6 |
| 5 | 0 | 0 | 0 | 0 | 1 | 2 | 3 | 3 | 4 | 5 | 6 | 7 | 8 | 9 | 8 |
| 6 | 0 | 0 | 0 | 0 | 1 | 2 | 3 | 4 | 5 | 6 | 7 | 8 | 10 | 10 | 11 |
| 7 | 0 | 0 | 0 | 1 | 2 | 3 | 3 | 4 | 5 | 7 | 8 | 10 | 12 | 13 | 14 |
| 8 | 0 | 0 | 0 | 1 | 2 | 3 | 4 | 5 | 6 | 9 | 11 | 13 | 17 | 18 | 19 |
| 9 | 0 | 0 | 0 | 1 | 2 | 3 | 4 | 6 | 8 | 10 | 16 | 18 | 23 | 28 | 28 |
| 10 | 0 | 0 | 0 | 1 | 3 | 4 | 5 | 6 | 9 | 12 | 18 | 23 | 31 | 36 | 38 |
| 11 | 0 | 0 | 0 | 2 | 3 | 4 | 5 | 7 | 10 | 14 | 20 | 31 | 40 | 50 | 57 |
| 12 | 0 | 0 | 0 | 2 | 3 | 4 | 5 | 7 | 11 | 17 | 26 | 41 | 64 | 85 | 92 |
| 13 | 0 | 0 | 0 | 2 | 3 | 4 | 5 | 8 | 12 | 19 | 32 | 56 | 104 | 149 | 164 |
| 14 | 0 | 0 | 1 | 2 | 3 | 4 | 5 | 8 | 13 | 20 | 35 | 66 | 138 | 212 | 230 |
| 15 | 0 | 0 | 1 | 2 | 3 | 4 | 5 | 8 | 13 | 21 | 37 | 72 | 154 | 225 | 254 |

CENTER OF LIGHT SOURCE

○ SAMPLING POINTS OF BLOCK

● POSITION OF COURENT PIXEL

DRIVING METHOD FOR LOCAL DIMMING OF LIQUID CRYSTAL DISPLAY DEVICE AND APPARATUS USING THE SAME

This application claims the benefit of Korean Patent Application No. 10-2009-0123597, filed on Dec. 11, 2009, which is hereby incorporated by reference as if fully set forth herein.

BACKGROUND OF THE INVENTION

1. Field of the Invention

The present invention relates to a Liquid Crystal Display (LCD) device, and more particularly, to a driving method for local dimming of an LCD device, which accurately detects the total light intensity of each pixel simply by changing light intensity data, in spite of a changed optical profile, and an apparatus using the same.

2. Discussion of the Related Art

Recently, flat panel displays have been popular as video displays, such as LCDs, Plasma Display Panels (PDPs), Organic Light Emitting Diodes (OLEDs), etc.

An LCD device includes a liquid crystal panel for displaying an image on a pixel matrix relying on the electrical and optical characteristics of liquid crystals that exhibit anisotropy in dielectric constant and refractive index, a driving circuit for driving the liquid crystal panel, and a backlight unit for irradiating light onto the liquid crystal panel. The gray scale of each pixel is adjusted by controlling the transmittance of light that passes from the backlight unit through the liquid crystal panel and polarizers through changing the orientation of liquid crystals according to a data signal.

In the LCD device, the luminance of each pixel is determined by the product between the luminance of the backlight unit and the light transmittance of liquid crystals that depends on data. The LCD device employs backlight dimming for the purposes of increasing a contrast ratio and reducing power consumption. Backlight dimming is a technique that controls backlight luminance and compensates data by analyzing an input image and adjusting a dimming value based on the analysis. For example, a backlight dimming method intended for reducing power consumption reduces the backlight luminance by decreasing the dimming value and increases the luminance through data compensation. Thus the power consumption of the backlight unit is reduced.

A Light Emitting Diode (LED) backlight unit using LEDs as light source has recently been used. The LEDs boast of high luminance and low power consumption, compared to conventional lamps. Because the LED backlight unit allow for location-based control, they may be driven by local dimming. According to the local dimming technology, the LED backlight unit is divided into a plurality of light emitting blocks and luminance is controlled on a bock-by-block basis. Local dimming may further increase the contrast ratio and decrease the power consumption since the backlight unit and the liquid crystal panel are divided into a plurality of blocks, local dimming values are decided by analyzing data on a block basis, and data is compensated based on the local dimming values.

However, the local dimming technique according to the related art controls the luminance of backlight unit on a block basis by dividing the backlight unit into a plurality of light emitting blocks, thus decreasing a total luminance, compared to global dimming in which the entire luminance of lamp backlight unit is controlled. In this context, the decreased backlight luminance is compensated for by compensating input data simultaneously with local dimming. For this purpose, the intensity of light that reaches each pixel is analyzed based on an optical profile specifying light intensities of a light source among the backlight unit according to distances from the light source, and a gain value is calculated for data compensation using the analyzed light intensity of the pixel. Therefore, the light intensity of each pixel should be accurately calculated to accurately compensate the luminance of data.

In a local dimming method according to the related art, the intensity of light that reaches each pixel from a light source is calculated using functions such as a Gaussian function, a Butterworth function, etc. with similar characteristics to an optical profile, as illustrated in FIG. 1. Although when backlight unit is illuminated with the same luminance across the entire area of a screen, the intensities of light reaching pixels should be identical, the light intensity is not equal at each pixel with respect to the same luminance of the backlight unit in case of the functions of the related art. The difference between compensation data for the same data under the same luminance of backlight unit may degrade image quality. Moreover, in the case where local dimming is performed by an algorithm that analyzes light intensity using the functions of the related art, if a change occurs to an optical profile according to the shape and type of a light source, a new algorithm should be employed.

SUMMARY OF THE INVENTION

Accordingly, the present invention is directed to a driving method for local dimming of a Liquid Crystal Display (LCD) device and an apparatus using the same that substantially obviate one or more problems due to limitations and disadvantages of the related art.

An object of the present invention is to provide a driving method for local dimming of an LCD device to accurately detect the total light intensity of each pixel simply by changing light intensity data, in spite of a change in an optical profile, and an apparatus using the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving method for local dimming of an LCD device includes measuring light intensities at a plurality of sampling points by driving a light source of a backlight unit and storing the light intensity measurements as light intensity data of the sampling points in a memory, determining a local dimming value of each block by analyzing input image data on a block basis, detecting a pixel position of current input data, selecting a plurality of sampling points adjacent to the current pixel and the light intensity data of the sampling points from the memory, detecting light intensity data of the current pixel by linearly interpolating the light intensity data of the sampling points individually, calculating a gain value by a light intensity analysis based on the light intensity data of the current pixel and the local dimming value of each block, compensating the current input data using the gain value, and controlling luminance of the backlight unit on a block basis using the local dimming value of each block.

The light intensity data of the sampling points may be stored in a two-dimensional matrix.

For calculation of the gain value, a first total intensity of light that reaches the current pixel may be calculated using the light intensity data of the current pixel, when the entire backlight unit is at a maximum luminance, a second total intensity of light that reaches the current pixel may be calculated by multiplying the first total light intensity by the local dimming value of each block, and a ratio of the second total light intensity to the first total light intensity may be calculated as the gain value.

In another aspect of the present invention, a method for driving an LCD device includes providing the compensated data to a liquid crystal panel by the above driving method, and displaying the input image data with a combination between the backlight luminance controlled on a block basis and a light transmittance controlled by the compensated data on the liquid crystal panel.

In another aspect of the present invention, a driving apparatus for local dimming of an LCD device includes an image analyzer for analyzing input image data for each block corresponding to each light emitting block of a backlight unit, a dimming value decider for determining a local dimming value of each block according to a result of the analysis of the image analyzer, a memory for storing light intensities of a plurality of sampling points measured by driving a light source as a backlight as light intensity data of the sampling points, a gain value decider for selecting a plurality of sampling points adjacent to the current pixel and the light intensity data of the sampling points from the memory, detecting light intensity data of the current pixel by linearly interpolating the light intensity data of the sampling points individually, and calculating a gain value by a light intensity analysis based on the light intensity data of the current pixel and the local dimming value of each block, and a data compensator for compensating the current input data using the gain value.

The gain value decider may include a pixel position detector for detecting a pixel position of the current input data using an input synchronization signal, a sampling point selector for selecting at least four sampling points adjacent to the current pixel and light intensity data of the selected sampling points from the memory, an interpolator for detecting the light intensity data of the current pixel by linearly interpolating the light intensity data received from the sampling point selector, taking into account distances between the current pixel and the sampling points, a light intensity analyzer for calculating a first total intensity of light that reaches the current pixel from a plurality of light sources adjacent to the current pixel using the light intensity data of the current pixel and the local dimming value of each block received from the dimming value decider, when the entire backlight unit is at a maximum luminance, and calculating a second total intensity of light that reaches the current pixel by applying the local dimming value of each block to the first total light intensity, and a gain value calculator for calculating the ratio of the second total light intensity to the first total light intensity as the gain value.

In a further aspect of the present invention, an LCD device includes the above driving apparatus for local dimming, a panel driver for providing compensated data received from the driving apparatus to a liquid crystal panel, a timing controller for outputting the compensated data received from the driving apparatus to the panel driver and controlling a driving timing of the panel driver, a backlight unit including a plurality of light emitting blocks for projecting light onto the liquid crystal panel, and a backlight driver for driving the plurality of light emitting blocks using local dimming values of individual blocks received from the driving apparatus.

The timing controller may have the driving apparatus inside.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
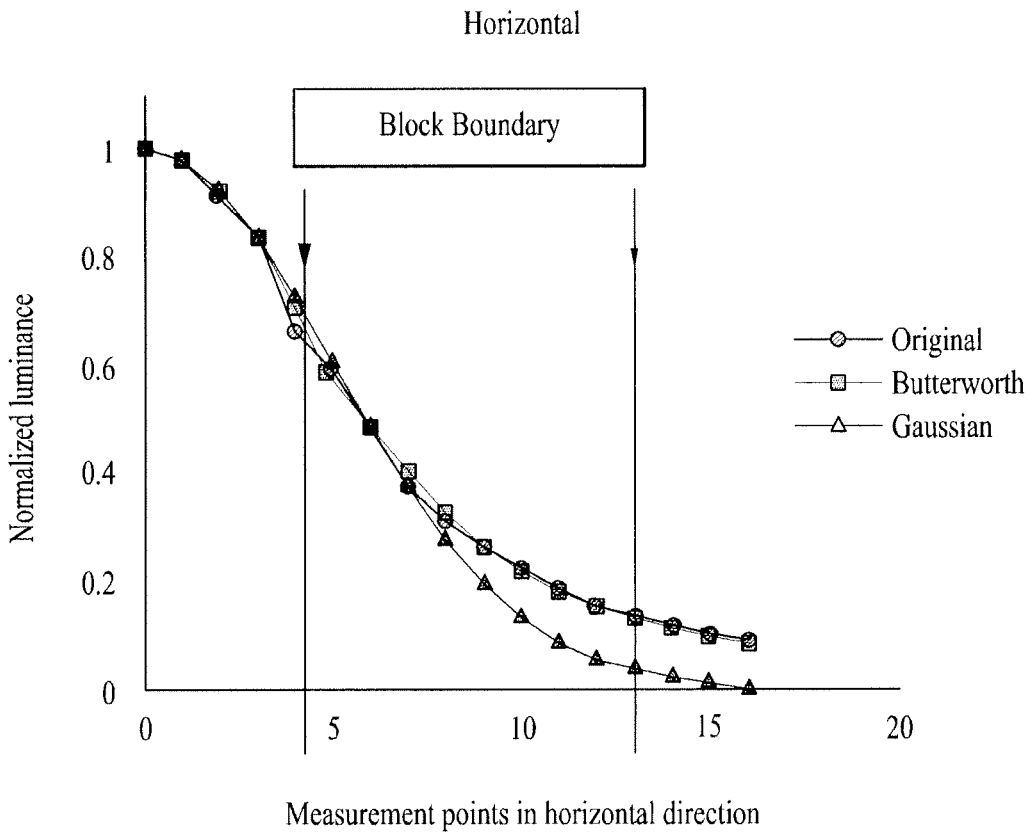
FIG. 1 Related Art
FIG. 1 is a graph illustrating an optical profile used in a dimming method according to the related art.
Figure 2:
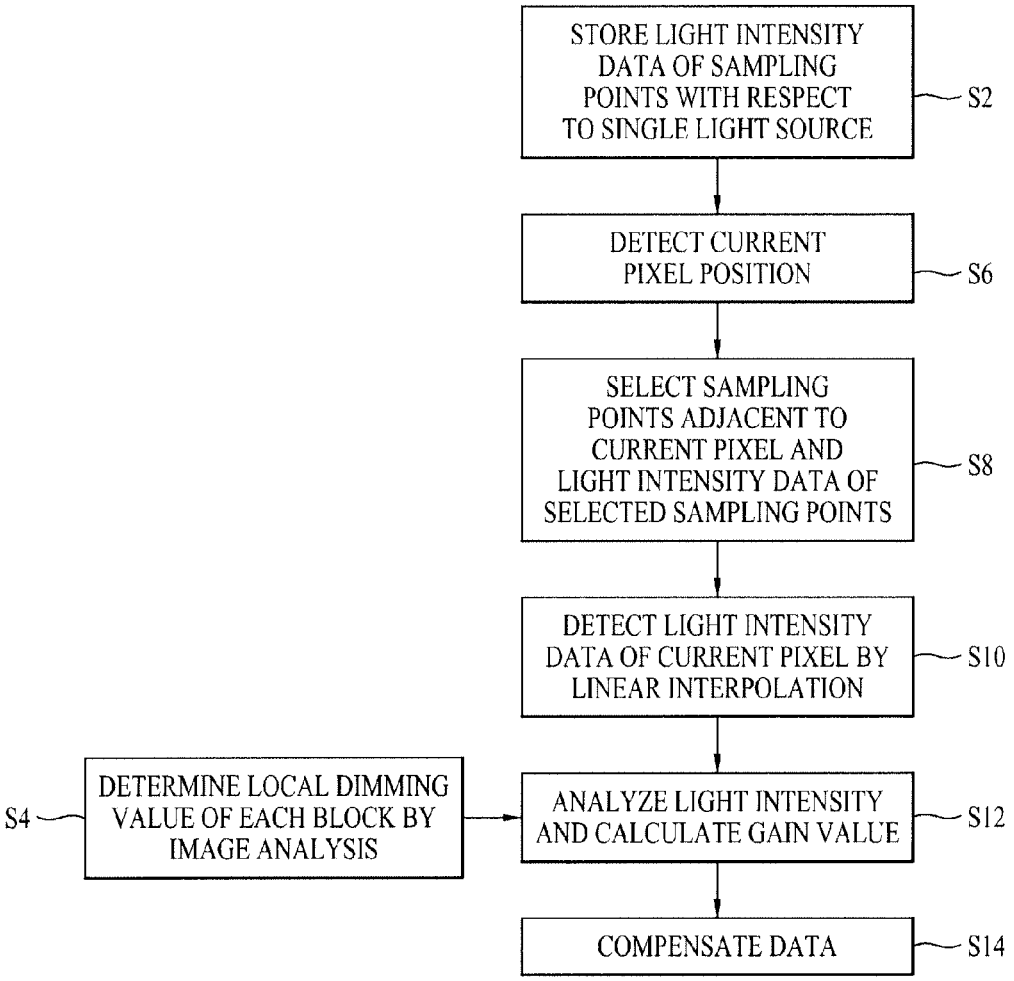
FIG. 2 is a flowchart illustrating a driving method for local dimming of a Liquid Crystal Display (LCD) device according to an exemplary embodiment of the present invention.

FIG. 2 is a flowchart illustrating a driving method for local dimming of a Liquid Crystal Display (LCD) device according to an exemplary embodiment of the present invention.

Figure 3:
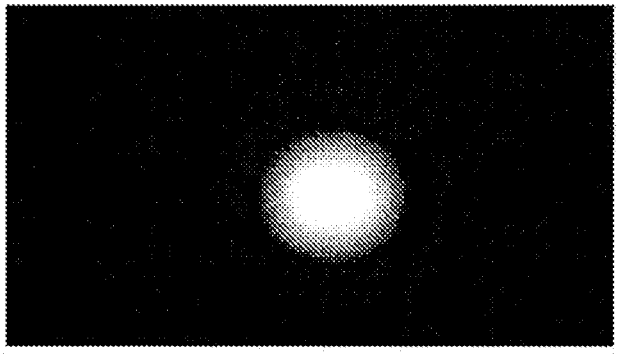
FIG. 3 illustrates a method for generating an optical profile for a light source according to the present invention.
Figure 3:
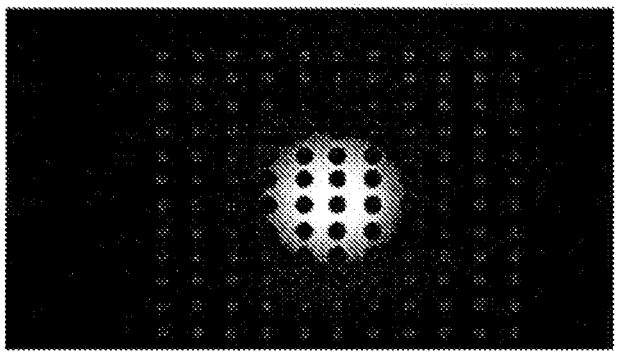

Referring to FIG. 2, a designer generates an optical profile for a light source as a backlight and stores the optical profile in a memory in step S2. Specifically, after driving a light source of a block on a screen as illustrated in FIG. 3(*a*), the designer measures light intensities at a plurality of sampling points arranged in a matrix as illustrated in FIG. 3(*b*), generates light intensity data (i.e. luminance data) of the sampling points, that is, an optical profile for the light source by normalizing the light intensity measurements, and stores the optical profile in the memory of the LCD device. The light intensity data of the respective sampling points are stored in a two-dimensional matrix as illustrated in FIG. 3, taking into account the oval shape of the block.

In step S4, a local dimming value is determined for each block by analyzing a frame of an input image on a block basis. For example, a maximum value is detected for each pixel from the input image, the maximum values of pixels are grouped on a block basis, and the maximum values of pixels in each block are summed and averaged. For each block, a local dimming value corresponding to the average of the maximum values of pixels in the block is determined. In general, the designer preliminarily maps local dimming values to average values of blocks in a look-up table. Hence, the local dimming value corresponding to the average value of each block is selected from the look-up table.

The pixel position of current input data is detected using input synchronization signals in step S6. For example, the vertical pixel position of the input data may be detected by counting a vertical synchronization signal among a plurality of synchronization signals and the horizontal pixel position of the input data may be detected by counting a dot clock signal during an enable period of a data enable signal.

In step S8, at least four sampling points P1 to P4 adjacent to the current pixel Pi and the light intensity data of the sampling points P1 to P4 are selected by comparing the position of the current pixel Pi with the positions of the sampling points stored in the memory. For instance, four sampling points above, below, on the left, and on the right of the current pixel, and the light intensity data of the four sampling points are selected, as illustrated in FIG. 3.

The light intensity data of the individual sampling points P1 to P4 are linearly interpolated in both horizontal and vertical directions, taking into account the distances between the current pixel Pi and the sampling points P1 to P4 and the resulting linear interpolation value is output as light intensity data of the current pixel Pi in step S10. If the current input data is a sampling point, the light intensity data of the sampling pint is output.

In step S12, first and second total intensities of light that reaches the current pixel Pi are calculated using the light intensity data of the current pixel Pi, output in step S10 and the local dimming value of each block, detected in step S4 and a gain value is calculated to be a ratio between the first and second total light intensities. Specifically, the first total light intensity of the current pixel Pi is calculated by summing the intensities of light that reaches the current data from a plurality of light sources adjacent to the current pixel Pi using the light intensity data of the current pixel Pi, in the case where the entire backlight unit is at a maximum luminance, and the second total light intensity, which is the intensity of light reaching the current pixel Pi from an adjacent block in the case where the luminance of the backlight unit is adjusted on a block basis according to the local dimming value of each block, is calculated by multiplying the first total light intensity by the local dimming value of each block and summing the products. Then, the ratio of the second total light intensity to the first total light intensity is calculated as a gain value for the current pixel Pi by [Equation 1].

Gain value for each pixel=(first total light intensity of the pixel at maximum luminance of backlight unit)/(second total light intensity of the pixel at backlight luminance adjusted by local dimming) [Equation 1]

In step S14, the luminance of the input data of the current pixel is compensated by multiplying the gain value of the pixel by the input data.

Figure 5:
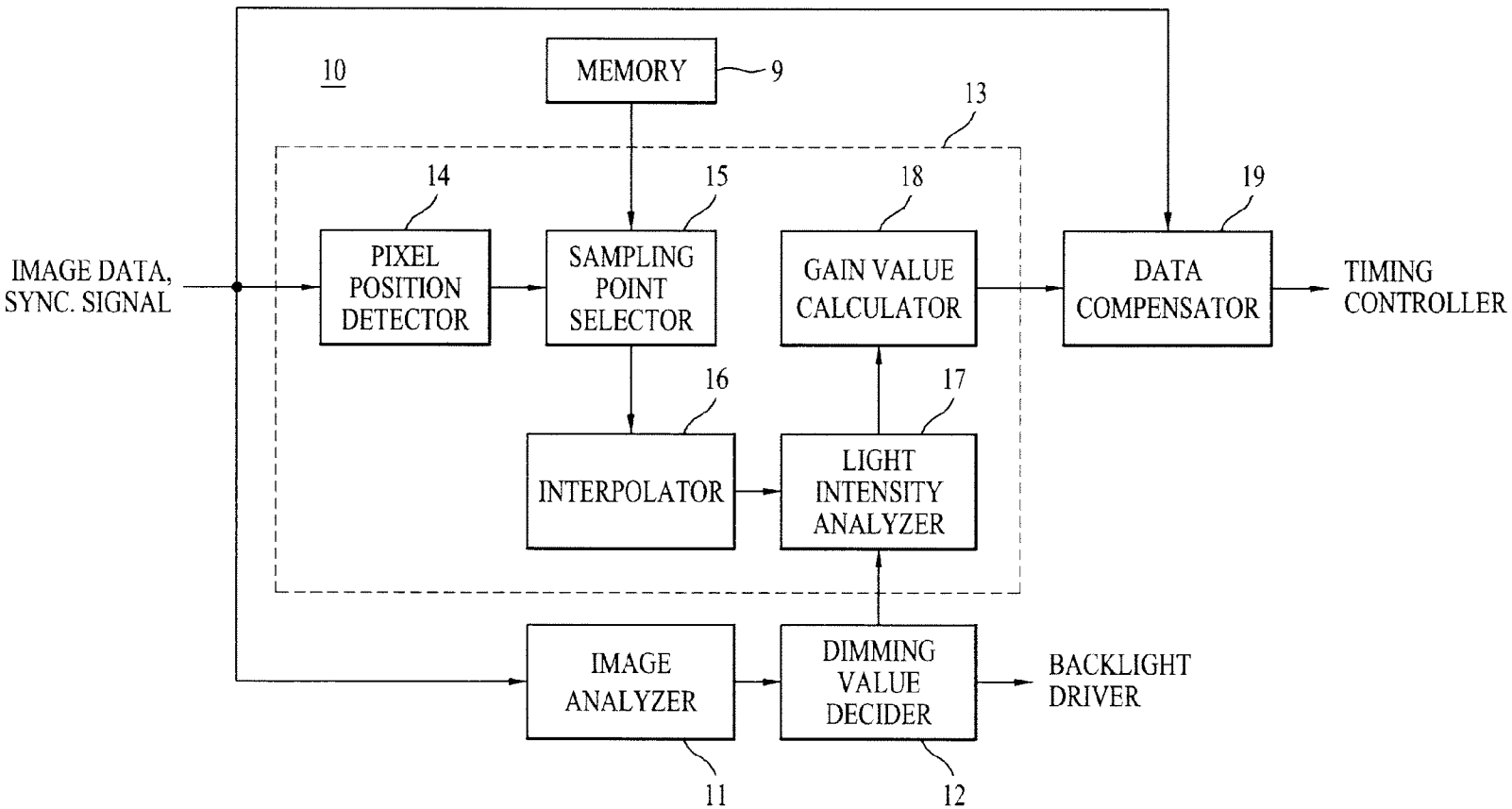
FIG. 5 is a block diagram of a local dimming driver according to an exemplary embodiment of the present invention.

FIG. 5 is a block diagram of a local dimming driver according to an exemplary embodiment of the present invention.

Referring to FIG. 5, a local dimming driver 10 includes an image analyzer 11, a dimming value decider 12, a gain value decider 13, and a data compensator 19. The gain value decider 13 has a pixel position detector 14, a sampling point selector 15, an interpolator 16, a light intensity analyzer 17, and a gain value calculator 18.

The image analyzer 11 analyzes input image data for each light emitting block of the backlight unit and outputs the analysis result to the dimming value decider 12. Specifically, the image analyzer 11 detects a maximum value for each pixel in the input image data, groups the maximum values of pixels on a block basis, and sums and averages the maximum values of pixels in each block. The average values of blocks are provided to the dimming value decider 12.

The dimming value decider 12 determines a local dimming value for each block corresponding to the average value of the block and outputs the local dimming values of the blocks to the gain decider 13. To be more specific, the dimming value decider 12 selects a local dimming value for each block corresponding to the average value of the block from a preset look-up table.

The gain decider 13 calculates a gain value for each pixel using an optical profile stored in the memory 9 and the local dimming value of each block received from the dimming value decider 12 and outputs the gain value of each pixel to the data compensator 19.

Figure 4:
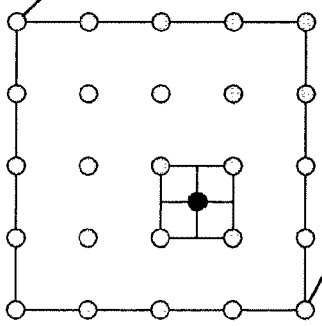
FIG. 4 illustrates exemplary light intensity data of individual sampling points, stored in a memory according to the present invention.

The memory 9 stores light intensity data that are measured at a plurality of sampling points by driving a light source of a block and then normalized, as illustrated in FIG. 4.

In the gain value decider 13, the position detector 14 detects the pixel position of current input data using input synchronization signals. For example, the vertical pixel position of the input data may be detected by counting a horizontal synchronization signal among a plurality of synchronization signals and the vertical pixel position of the input data may be detected by counting a dot clock signal during an enable period of a data enable signal.

The sampling point selector 15 selects at least four sampling points adjacent to the current pixel and the light intensity data of the four sampling points by comparing the position of the current pixel with the positions of the sampling points stored in the memory 9.

The interpolator 16 linearly interpolates the light intensity data of the individual sampling points in both horizontal and vertical directions, taking into account the distances between the current pixel and the sampling points and outputs the resulting linear interpolation value as light intensity data of the current pixel. If the current input data is a sampling point, the interpolator 16 outputs the light intensity data of the sampling pint.

The light intensity analyzer 17 calculates first and second total intensities of light that reaches the current pixel using the light intensity data of the current pixel received from the interpolator 16 and the local dimming value of each block received from the dimming value decider 12. Specifically, the light intensity analyzer 17 calculates the first total light intensity of the current pixel by summing the intensities of light that reaches the current data from a plurality of light sources adjacent to the current pixel using the light intensity data of the current pixel, in the case where the entire backlight unit is at a maximum luminance, and then calculates the second total light intensity, which is the intensity of light reaching the current pixel Pi from an adjacent block in the case where the luminance of the backlight unit is adjusted on a block basis according to the local dimming value of each block, by multiplying the first total light intensity by the local dimming value of each block and summing the products.

The gain value calculator 18 calculates the ratio of the second total light intensity to the first total light intensity as a gain value for the current pixel.

The data compensator 19 compensates the luminance of the current pixel data by multiplying the gain value received from the gain value calculator 18 by the current pixel data.

As described above, in accordance with the driving method and apparatus for local dimming of an LCD device according to the present invention, the light intensity data of sampling points adjacent to a current pixel are selected from the current optical profile of a light source and the light intensity data of the current pixel is detected by linearly interpolating the light intensity data of the sampling points. Since data is compensated by applying the same light intensity data to each pixel on a screen with the same luminance, image quality can be improved. Further, the present invention can be simply implemented by changing optical profile data stored in the memory without changing an algorithm, even though the optical profile is changed according to the shape and type of the light source.

Figure 6:
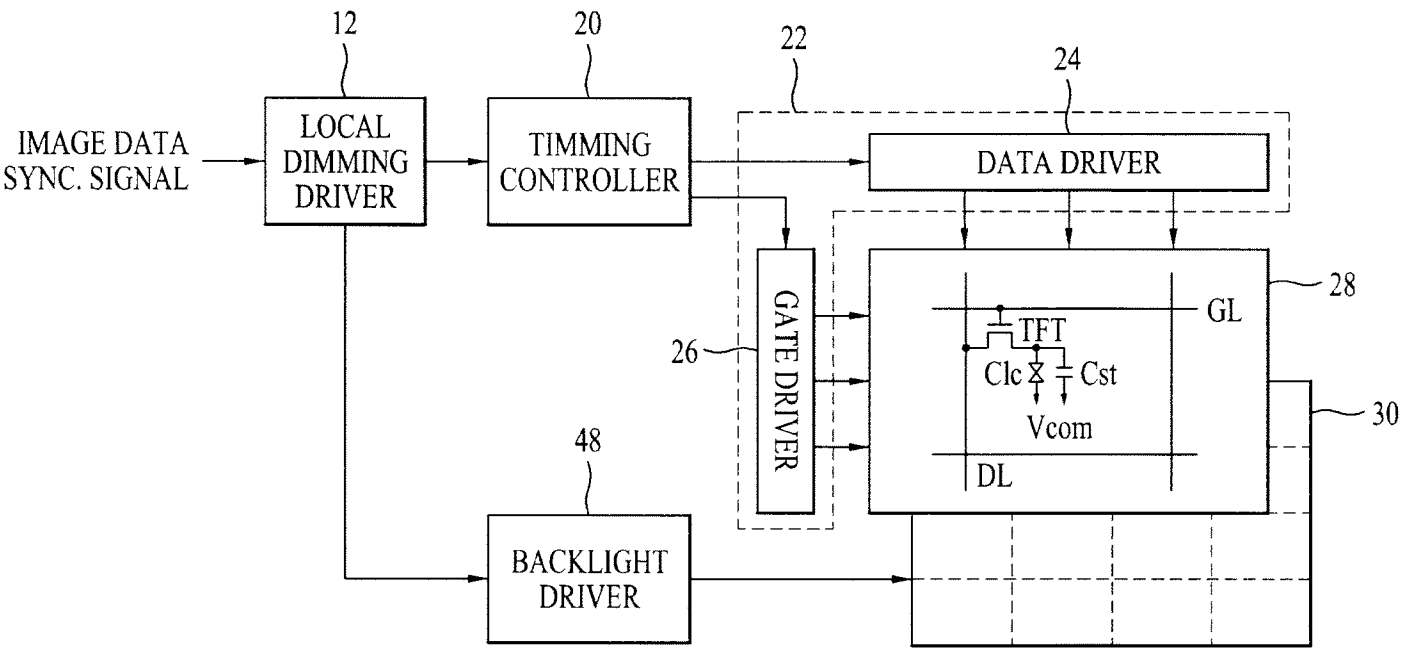
FIG. 6 is a block diagram of an LCD device according to an exemplary embodiment of the present invention.

FIG. 6 is a block diagram of an LCD device to which the local dimming driver 10 illustrated in FIG. 5 is applied according to an exemplary embodiment of the present invention.

Referring to FIG. 6, the LCD device includes the local dimming driver 10 for determining a local dimming value for each block by analyzing input image data on a block basis, a timing controller 20 for providing the data received from the local dimming driver 12 to a panel driver 22 and controlling a driving timing of the panel driver 22, a backlight driver 30 for driving an LED backlight unit 40 on a block basis based on the local dimming value of each block received from the local dimming driver 10, and a liquid crystal panel 28 driven by a data driver 24 and a gate driver 26 of the panel driver 22. The local dimming driver 10 may be provided inside the timing controller 20.

In operation, the local dimming driver 10 analyzes input image data on a block basis using synchronization signals, determines a local dimming value for each block according to the analysis result, and outputs the local dimming value of each block to the backlight driver 30. The local dimming driver 10 also selects the light intensity data of sampling points adjacent to a current pixel from the memory, detects light intensity data of the current pixel by linearly interpolating the light intensity data of the sampling points, calculates a gain value for the current pixel by a light intensity analysis based on the light intensity data of the current pixel and the local dimming value of each block, compensates the current pixel data using the gain value, and outputs the compensated current pixel data to the timing controller 20, as described before, The timing controller 20 orders the data received from the local dimming driver 10 and outputs the ordered data to the data driver 24 of the panel driver 22. The timing controller 20 generates data control signals for controlling driving timings of the data driver 24 and gate control signals for controlling driving timings of the gate driver 26, using a plurality of synchronization signals received from the local dimming driver 10, specifically a vertical synchronization signal, a horizontal synchronization signal, a data enable signal, and a dot clock signal, and outputs the data control signals and the gate control signals respectively to the data driver 24 and the gate driver 26. Meanwhile, the timing controller 20 may further include an overdriving circuit (not shown) for modulating data by applying an overshoot value or an undershoot value to the data according to a data difference between successive frames in order to increase the response speed of liquid crystals.

The panel driver 22 includes the data driver 24 for driving data lines DL of the liquid crystal panel 28 and gate lines GL of the liquid crystal panel 28.

The data driver 24 converts digital video data received from the timing controller 24 to analog data signals (pixel voltage signals) using gamma voltages in response to the data control signals received from the timing controller 20 and provides the analog data signals to the data lines DL of the liquid crystal panel 28.

The gate driver 26 sequentially drives the gate lines GL of the liquid crystal panel 28 in response to the gate control signals received from the timing controller 20.

The liquid crystal panel 28 displays an image through a pixel matrix having a plurality of pixels arranged. Each pixel represents a desired color by combining red, green and blue sub-pixels that control light transmittance through changing the orientation of the liquid crystals according to a luminance-compensated data signal. Each of the sub-pixels includes a Thin Film Transistor (TFT) connected to a gate line GL and a data line DL, and a liquid crystal capacitor Clc and a storage capacitor Cst that are connected to the TFT in parallel. The liquid crystal capacitor Clc is charged with a different voltage between a data signal supplied to a pixel electrode through the TFT and a common voltage Vcom supplied to a common electrode and drives a liquid crystal according to the charged voltage, to thereby control light transmittance. The storage capacitor Cst maintains the voltage charged at the liquid crystal capacitor Clc to be stable.

The backlight driver 30 drives the LED backlight unit 40 on a block basis according to the local dimming value of each block received from the local dimming driver 10, thus controlling the luminance of the LED backlight unit 40 on a block basis. If the LED backlight unit 40 is divided into a plurality of ports, a plurality of backlight drivers 30 may be provided to drive the plurality of ports independently. The backlight driver 30 generates a Pulse Width Modulation (PWM) signal with a duty ratio corresponding to the local dimming value of each block on a block basis and provides an LED driving signal corresponding to the PWM signal for each block to the block, thereby driving the LED backlight unit 40 on a block basis. The backlight driver 30 sequentially drives the light emitting blocks using local dimming values received from the local dimming driver 10 in a block connection order, thus controlling the luminance of backlight unit on a block basis.

Accordingly, the LCD device of the present invention displays the input image data with the product between the backlight luminance controlled on a block basis and a light transmittance controlled by the compensated data in the liquid crystal panel.

As is apparent from the above description, the driving method for local dimming of an LCD device and an apparatus using the same according to the present invention detect the light intensity data of individual sampling points with respect to a light source, store the light intensity data as a two-dimensional optical profile, select the light intensity data of sampling points adjacent to a current pixel, and detect the light intensity data of the current pixel by linearly interpolating the light intensity data of the sampling points. Since data is compensated by applying the same light intensity data to each pixel on a screen with the same luminance, image quality can be improved. Further, the present invention can be simply implemented by changing optical profile data stored in the memory without changing an algorithm, even though the optical profile is changed according to the shape and type of the light source.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A driving method for local dimming of a Liquid Crystal Display (LCD) device, comprising:

measuring light intensities at a plurality of sampling points by driving a light source of a backlight unit, generating light intensity data of the sampling points as an optical profile for the light source by normalizing the light intensity measurements, and storing the light intensity data of the sampling points in a memory;

determining a local dimming value of each block by analyzing input image data on a block basis;

detecting a pixel position of current input data;

selecting a plurality of sampling points adjacent to the current pixel and the light intensity data of the selected sampling points from the memory;

obtaining light intensity data of the current pixel by linearly interpolating the light intensity data of the selected sampling points individually;

calculating first and second total intensities of light that reach the current pixel using the light intensity data of the current pixel and the local dimming value of each block, and calculating a ratio between the first and second total light intensities as a gain value;

compensating the current input data using the gain value; and controlling luminance of the backlight unit on a block basis using the local dimming value of each block.

2. The driving method according to claim 1, wherein the light intensity data of the sampling points are stored in a two-dimensional matrix.

3. The driving method according to claim 1, wherein the gain value calculation comprises:

calculating a first total intensity of light that reaches the current pixel using the light intensity data of the current pixel, when the entire backlight unit is at a maximum luminance;

calculating a second total intensity of light that reaches the current pixel by multiplying the first total light intensity by the local dimming value of each block; and calculating a ratio of the first total light intensity to the second total light intensity as the gain value.

4. A method for driving a Liquid Crystal Display (LCD) device, comprising:

providing the compensated data to a liquid crystal panel using a driving method for local dimming; and displaying the input image data with a combination between the backlight luminance controlled on a block basis and a light transmittance controlled by the compensated data on the liquid crystal panel, wherein the driving method for local dimming comprises:

measuring light intensities at a plurality of sampling points by driving a light source as a backlight unit, generating light intensity data of the sampling points as an optical profile for the light source by normalizing the light intensity measurements, and storing the light intensity data of the sampling points in a memory;

determining a local dimming value of each block by analyzing input image data on a block basis;

detecting a pixel position of current input data;

selecting a plurality of sampling points adjacent to the current pixel and the light intensity data of the selected sampling points from the memory;

obtaining light intensity data of the current pixel by linearly interpolating the light intensity data of the selected sampling points individually;

calculating first and second total intensities of light that reaches the current pixel using the light intensity data of the current pixel and the local dimming value of each block, and calculating a ratio between the first and second total light intensities as a gain value;

compensating the current input data using the gain value; and controlling luminance of the backlight unit on a block basis using the local dimming value of each block.

5. The driving method according to claim 4, wherein the light intensity data of the sampling points are stored in a two-dimensional matrix.

6. The driving method according to claim 4, wherein the gain value calculation comprises:

calculating a first total intensity of light that reaches the current pixel using the light intensity data of the current pixel, when the entire backlight unit is at a maximum luminance;

calculating a second total intensity of light that reaches the current pixel by multiplying the first total light intensity by the local dimming value of each block; and calculating a ratio of the first total light intensity to the second total light intensity as the gain value.

7. A driving apparatus for local dimming of a Liquid Crystal Display (LCD) device, comprising:

an image analyzer for analyzing input image data for each block corresponding to each light emitting block of a backlight unit;

a dimming value decider for determining a local dimming value of each block according to a result of the analysis of the image analyzer;

a memory for storing light intensity data of a plurality of sampling points, wherein the light intensity data of a plurality of sampling points are an optical profile for a light source and are generated by normalizing the light intensity measurements which are measured at the plurality of sampling points when driving a light source of a backlight unit;

a gain value decider for selecting a plurality of sampling points adjacent to the current pixel and the light intensity data of the selected sampling points from the memory, obtaining light intensity data of the current pixel by linearly interpolating the light intensity data of the selected sampling points individually, calculating first and second total intensities of light that reach the current pixel using the light intensity data of the current pixel and the local dimming value of each block, and calculating a ratio between the first and second total light intensities as a gain value; and a data compensator for compensating the current input data using the gain value.

8. The driving apparatus according to claim 7, wherein the gain value decider comprises:

a pixel position detector for detecting a pixel position of the current input data using an input synchronization signal;

a sampling point selector for selecting at least four sampling points adjacent to the current pixel and light intensity data of the selected sampling points from the memory;

an interpolator for obtaining the light intensity data of the current pixel by linearly interpolating the light intensity data received from the sampling point selector, taking into account distances between the current pixel and the sampling points;

a light intensity analyzer for calculating a first total intensity of light that reaches the current pixel using the light intensity data of the current pixel, when the entire backlight unit is at a maximum luminance, and calculating a second total intensity of light that reaches the current pixel by multiplying the first total light intensity by the local dimming value of each block; and a gain value calculator for calculating the ratio of the first total light intensity to the second total light intensity as the gain value.

9. A Liquid Crystal Display (LCD) device comprising:

a local dimming driver;

a panel driver for providing compensated data received from the local dimming driver to a liquid crystal panel;

a timing controller for outputting the compensated data received from the local dimming driver to the panel driver and controlling a driving timing of the panel driver;

a backlight unit including a plurality of light emitting blocks for projecting light onto the liquid crystal panel; and a backlight driver for driving the plurality of light emitting blocks using local dimming values of individual blocks received from the local dimming driver, wherein the local dimming driver comprises:

an image analyzer for analyzing input image data for each block corresponding to each light emitting block of the backlight unit;

a dimming value decider for determining a local dimming value of each block according to a result of the analysis of the image analyzer;

a memory for storing light intensity data of a plurality of sampling points, wherein the light intensity data of a plurality of sampling points are an optical profile for a light source and are generated by normalizing the light intensity measurements which are measured at the plurality of sampling points when driving a light source of a backlight unit;

a gain value decider for selecting a plurality of sampling points adjacent to the current pixel and the light intensity data of the selected sampling points from the memory, obtaining light intensity data of the current pixel by linearly interpolating the light intensity data of the selected sampling points individually, calculating first and second total intensities of light that reaches the current pixel using the light intensity data of the current pixel and the local dimming value of each block, and calculating a ratio between the first and second total light intensities as a gain value; and a data compensator for compensating the current input data using the gain value.

10. The LCD device according to claim 9, wherein the gain value decider comprises:

a pixel position detector for detecting a pixel position of the current input data using an input synchronization signal;

a sampling point selector for selecting at least four sampling points adjacent to the current pixel and light intensity data of the selected sampling points from the memory;

an interpolator for obtaining the light intensity data of the current pixel by linearly interpolating the light intensity data received from the sampling point selector, taking into account distances between the current pixel and the sampling points;

a light intensity analyzer for calculating a first total intensity of light that reaches the current pixel using the light intensity data of the current pixel, when the entire backlight unit is at a maximum luminance, and calculating a second total intensity of light that reaches the current pixel by multiplying the first total light intensity by the local dimming value of each block; and a gain value calculator for calculating the ratio of the first total light intensity to the second total light intensity as the gain value.

11. The LCD device according to claim 9, wherein the timing controller has the local dimming driver inside.

* * * * *